US009414139B2

(12) United States Patent
Inoue et al.

(10) Patent No.: US 9,414,139 B2
(45) Date of Patent: Aug. 9, 2016

(54) ACOUSTIC TRANSDUCER

(71) Applicant: OMRON Corporation, Kyoto-shi, Kyoto (JP)

(72) Inventors: Tadashi Inoue, Shiga (JP); Takashi Kasai, Shiga (JP)

(73) Assignee: OMRON Corporation, Kyoto (JP)

( * ) Notice: Subject to any disclaimer, the term of this patent is extended or adjusted under 35 U.S.C. 154(b) by 0 days.

(21) Appl. No.: 14/425,641

(22) PCT Filed: Aug. 12, 2013

(86) PCT No.: PCT/JP2013/071829

§ 371 (c)(1),
(2) Date: Mar. 4, 2015

(87) PCT Pub. No.: WO2014/041942

PCT Pub. Date: Mar. 20, 2014

(65) Prior Publication Data

US 2015/0230011 A1 Aug. 13, 2015

(30) Foreign Application Priority Data

Sep. 11, 2012 (JP) ..... 2012-199960

(51) Int. Cl.

| | |
|---|---|
| ***H04R 25/00*** | (2006.01) |
| ***H04R 1/00*** | (2006.01) |
| ***H04R 19/00*** | (2006.01) |
| *H04R 3/00* | (2006.01) |

(52) U.S. Cl.
CPC ..... *H04R 1/00* (2013.01); *H04R 19/005* (2013.01); *H04R 2201/003* (2013.01)

(58) Field of Classification Search
CPC ..... H04R 19/005; H04R 19/01; H04R 19/13; H04R 19/016; H04R 19/02; H04R 19/04
USPC ..... 381/173, 113, 174, 175, 191, 162
See application file for complete search history.

(56) References Cited

U.S. PATENT DOCUMENTS

| | | | | |
|---|---|---|---|---|
| 8,803,257 | B2 | 8/2014 | Kasai et al. | |
| 2008/0019543 | A1 * | 1/2008 | Suzuki | H04R 19/005 381/174 |
| 2011/0140213 | A1 | 6/2011 | Kasia et al. | |

FOREIGN PATENT DOCUMENTS

| | | | |
|---|---|---|---|
| JP | 2010-056745 | A | 3/2010 |
| WO | 02/15636 | A2 | 2/2002 |

OTHER PUBLICATIONS

International Search Report issued in PCT/JP2013/071829 mailed on Nov. 12, 2013 (2 pages).

* cited by examiner

*Primary Examiner* — Sunita Joshi
(74) *Attorney, Agent, or Firm* — Osha Liang LLP

(57) ABSTRACT

An acoustic transducer has a substrate having a cavity that is open at a top of the substrate, a vibration electrode film provided above the substrate so as to cover the cavity, and a fixed electrode film provided a distance above the vibration electrode film. A gap is formed between an upper surface of the substrate and a lower surface of the vibration electrode film around the cavity. In the gap across which the upper surface of the substrate and the lower surface of the vibration electrode film face each other, a narrow portion of the gap that is narrower than another portion of the gap is disposed. The narrow portion of the gap extends linearly.

9 Claims, 16 Drawing Sheets

ACOUSTIC TRANSDUCER

CROSS-REFERENCE TO RELATED APPLICATIONS

This is a National Stage application of PCT Application No. PCT/JP2013/071829, with an International filing date of Aug. 12, 2013, which claims priority of Japanese Patent Application No. 2012-199960 filed on Sep. 11, 2012, the entire contents of which is hereby incorporated by reference.

BACKGROUND

1. Technical Field

The present invention relates to an acoustic transducer that converts acoustic vibrations into electrical signals, or converts electrical signals into acoustic vibrations, and more particularly, to an acoustic transducer such as an acoustic sensor or a speaker manufactured using MEMS technology.

2. Related Art

FIG. 1 is a cross-sectional view showing a portion of a conventional acoustic sensor manufactured using MEMS technology. In an acoustic sensor 11, a diaphragm 14 (vibration electrode film) having conductivity is provided above an upper surface of a silicon substrate 13. The silicon substrate 13 has a back chamber 12 vertically penetrating therethrough. The top of the back chamber 12 is covered by the diaphragm 14. Further, a dome-shaped protective film 15 is formed above the upper surface of the silicon substrate 13, enclosing the diaphragm 14. The protective film 15 is formed with a fixed electrode film 16 at a position facing the diaphragm 14. The diaphragm 14 and the fixed electrode film 16 constitute a capacitor for converting acoustic vibrations into electrical signals. Multiple acoustic holes 17 are formed in the protective film 15 and the fixed electrode film 16 to allow acoustic vibrations (sound) to pass through them.

In the acoustic sensor 11 shown in FIG. 1, the diaphragm 14 is formed in parallel with the upper surface of the silicon substrate 13 in a region where the silicon substrate 13 and the diaphragm 14 face each other. In particular, in a direction parallel to the upper surface of the silicon substrate 13 and orthogonal to an edge of a top opening of the back chamber 12, the height of a gap between the silicon substrate 13 and the diaphragm 14 (hereinafter, the gap is referred to as a vent hole 18) is uniform. Such an acoustic sensor is disclosed, for example, in Patent Document 1.

A vent hole of an acoustic sensor serves as an acoustic resistance to acoustic vibrations entering through acoustic holes and passing to a back chamber, and has an important function for ensuring sensitivity in the bass range. On the other hand, air in the vent hole has characteristics as a viscous fluid, and thus the vent hole also functions as a noise (thermal noise) source.

Noise in the vent hole is mainly caused by a mechanical resistance due to the viscosity of air present in the gap (vent hole) between an edge portion of a diaphragm and an upper surface of a silicon substrate (this is called a film damping effect.). Specifically, when the diaphragm tries to move in a direction to be taken off from the substrate (upward), the viscosity of air in the vent hole generates a resistance hindering the upward movement of the diaphragm. Conversely, when the diaphragm tries to move in a direction to be pressed against the substrate (downward), it generates a resistance hindering the downward movement of the diaphragm. Noise caused by a mechanical resistive component at this time constitutes noise in the vent hole.

In the acoustic sensor 11 shown in FIG. 1, in an attempt to reduce generation of noise in the vent hole 18, the diaphragm 14 may be moved away from the upper surface of the silicon substrate 13 to increase the height H of the vent hole 18 like the diaphragm 14 shown in solid lines in FIG. 2A. Alternatively, like the diaphragm 14 shown in solid lines in FIG. 2B, the edge of the diaphragm 14 may be retracted toward the center to shorten the overlap length between the diaphragm 14 and the upper surface of the silicon substrate 13 (width W of the vent hole 18).

However, either when the height H of the vent hole 18 is increased or when the width W of the vent hole 18 is shortened, the acoustic resistance of the vent hole 18 is reduced. Therefore, acoustic vibrations are likely to leak into the back chamber 12 through the vent hole 18, lowering the sensitivity of the acoustic sensor 11 in the bass range. FIG. 3 is a graph showing the sensitivity of the acoustic sensor, with a horizontal axis representing the frequency of acoustic vibrations (vibration frequency), with a vertical axis representing the sensitivity. A curve shown in a dashed line in FIG. 3 represents the sensitivity-frequency characteristics (hereinafter, referred to as frequency characteristics) when the diaphragm 14 is in a position shown in dashed lines in FIG. 2A or FIG. 2B. When the height H of the vent hole 18 is increased as shown in solid lines in FIG. 2A, the sensitivity of the acoustic sensor decreases in the bass range (low audio frequency range) like the frequency characteristics shown in a solid line in FIG. 3. When the width W of the vent hole 18 is shortened as shown in solid lines in FIG. 2B, the sensitivity of the acoustic sensor decreases in the bass range like the frequency characteristics shown in the solid line in FIG. 3. That is, an attempt to reduce noise in the acoustic sensor causes a decrease in sensitivity in the bass range, narrowing a flat range in the frequency characteristics.

On the contrary, in order to provide excellent frequency characteristics of the acoustic sensor (that is, in order to widen the flat range in the frequency characteristics), the diaphragm 14 may be moved closer to the upper surface of the silicon substrate 13 to decrease the height H of the vent hole 18 to increase the acoustic resistance in the vent hole 18. Alternatively, the width W of the vent hole 18 may be lengthened to increase the acoustic resistance. However, in these cases, noise generated in the vent hole 18 increases, degrading the S/N ratio of the acoustic sensor.

Thus, in the conventional acoustic sensor, achieving a high S/N ratio by reducing noise and achieving almost flat frequency characteristics also in the bass range are in a trade-off relationship. It has been difficult to achieve both of them. FIG. 4 is a graph showing a relationship between the S/N ratio (vertical axis) and the roll-off frequency in an acoustic sensor as in FIG. 1. Generally, a roll-off frequency fr is a frequency at a point where the sensitivity decreases by −3 dB compared to the sensitivity at a frequency of 1 kHz. As the roll-off frequency fr becomes smaller, the flat range in sensitivity extends toward the bass range, providing excellent frequency characteristics. FIG. 4 shows that when the roll-off frequency is decreased, the S/N ratio decreases, and when the S/N ratio is increased, the roll-off frequency increases, reducing the sensitivity in the bass range.

Next, FIG. 5A is a cross-sectional view showing a portion of another conventional acoustic sensor manufactured using MEMS technology. FIG. 5B is an enlarged perspective view showing a portion of a diaphragm used in the acoustic sensor in FIG. 5A. In an acoustic sensor 21, a plurality of stoppers 22 is provided on a lower surface of a diaphragm 14. The stoppers 22 prevent an edge portion of the diaphragm 14 from sticking to an upper surface of a silicon substrate 13 and becoming immovable. Such an acoustic sensor is disclosed, for example, in Patent Document 2.

According to the acoustic sensor 21, the distance between the stoppers 22 and the upper surface of the silicon substrate 13 is smaller than the distance between a lower surface of the edge portion of the diaphragm 14 and the upper surface of the silicon substrate 13. Thus, it seems that the stoppers 22 can increase acoustic resistance to increase the sensitivity of the acoustic sensor 21 in the bass range. However, the stoppers 22 are intended to prevent the diaphragm 14 from sticking to the silicon substrate 13, and are formed in a thin pillar shape and provided only sparsely at intervals. Therefore, the stoppers 22 do not have an effect of preventing acoustic vibrations from passing through the vent hole 18. There is no effect of improving the sensitivity of the acoustic sensor 21 by increasing the acoustic resistance.

PATENT DOCUMENTS

Patent Document 1: Japanese Unexamined Patent Publication No. 2010-056745

Patent Document 2: WO 2002/015636 A (JP 2004-506394 W)

SUMMARY

An acoustic transducer according to one or more embodiments of the present invention can reduce generation of noise in a vent hole and flatten frequency characteristics in the bass range more.

An acoustic transducer according to one or more embodiments of the present invention includes a substrate having a cavity opening at the top, a vibration electrode film provided above the substrate so as to cover the cavity, and a fixed electrode film provided above the vibration electrode film at a distance, in which a gap is formed between an upper surface of the substrate and a lower surface of the vibration electrode film around the cavity, and in the gap across which the upper surface of the substrate and the lower surface of the vibration electrode film face each other, one portion of the gap is narrower than the other portion of the gap, the narrower portion of the gap extending linearly. Here, the linearly extending portion is not limited to the portion extending in a straight line, and may be curved or bent. Further, it is not limited to the portion extending in one direction, and may be branched into two or more directions.

In the acoustic transducer in one or more embodiments of the present invention, since in the gap across which the upper surface of the substrate and the lower surface of the vibration electrode film face each other, a size of the gap in the linearly extending portion is smaller than that in the other portion of the gap, the portion having a smaller size of the gap can increase acoustic resistance, preventing a reduction in sensitivity in the bass range. Further, since the size of the gap in the other portion is larger, noise can be reduced to increase the S/N ratio. Thus, according to an acoustic transducer of one or more embodiments of the present invention, an acoustic transducer with a high S/N ratio and excellent frequency characteristics can be fabricated.

In an acoustic transducer according to one or more embodiments of the present invention, the narrower portion of the gap formed between the upper surface of the substrate and the lower surface of the vibration electrode film extends in a direction other than a direction orthogonal to an end edge of the vibration electrode film to increase acoustic resistance. In particular, when extending in a direction parallel to the end edge of the vibration electrode film, the narrower portion of the gap formed between the upper surface of the substrate and the lower surface of the vibration electrode film has a great effect of increasing acoustic resistance to provide excellent frequency characteristics.

In an acoustic transducer according to one or more embodiments of the present invention, a size of the gap at an end edge of the vibration electrode film is smaller than a size at an edge of the top opening of the cavity. One or more embodiments of the present invention may only require deformation of a portion of the vibration electrode film facing the substrate, thus facilitating processing of the vibration electrode film.

In an acoustic transducer of one or more embodiments of the present invention, a portion of the vibration electrode film facing the upper surface of the substrate is curved in cross section such that the end edge of the vibration electrode film comes closer to the upper surface of the substrate. One or more embodiments of the present invention may allow for easy deformation of the portion of the vibration electrode film facing the upper surface of the substrate by controlling the inner stress of the vibration electrode film, facilitating the manufacturing of the acoustic transducer.

Alternatively, a portion of the vibration electrode film facing the upper surface of the substrate may be bent in cross section such that the end edge of the vibration electrode film comes closer to the upper surface of the substrate. Alternatively, a size of the gap at an intermediate position between an edge of the top opening of the cavity and an end edge of the vibration electrode film may be smaller than a size of the gap at the edge of the top opening of the cavity and a size of the gap at the end edge of the vibration electrode film.

In an acoustic transducer according to one or more embodiments of the present invention, a stopper is projected from a lower surface of a portion of the vibration electrode film facing the upper surface of the substrate, the projection length of the stopper being greater than a height difference between a proximal end of the stopper and a lowermost end of the vibration electrode film. According to one or more embodiments of the present invention, the stopper can strike the substrate, preventing the substrate from contacting the vibration electrode film, and preventing the vibration electrode film from sticking to the substrate.

In an acoustic transducer according to one or more embodiments of the present invention, a projecting portion is provided on the upper surface of the substrate in a region of the upper surface of the substrate facing the vibration electrode film, the projecting portion reducing a size of the gap formed between the upper surface of the substrate and the lower surface of the vibration electrode film. One or more embodiments of the present invention may only require provision of the projecting portion on the upper surface of the substrate, thus increasing the degree of freedom in design and manufacturing.

Various combinations of the above-described components are within a scope of the present invention.

DETAILED DESCRIPTION

Hereinafter, with reference to the accompanying drawings, embodiments of the present invention will be described. In embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid obscuring the invention.

Although acoustic sensors will be illustrated as an example below, the present invention is not limited to acoustic sensors, and may be applied to speakers and others manufactured using MEMS technology. The present invention is not limited to the embodiments below, and various design changes may be made without departing from the scope of the present invention.

Embodiment 1

Figure 6:
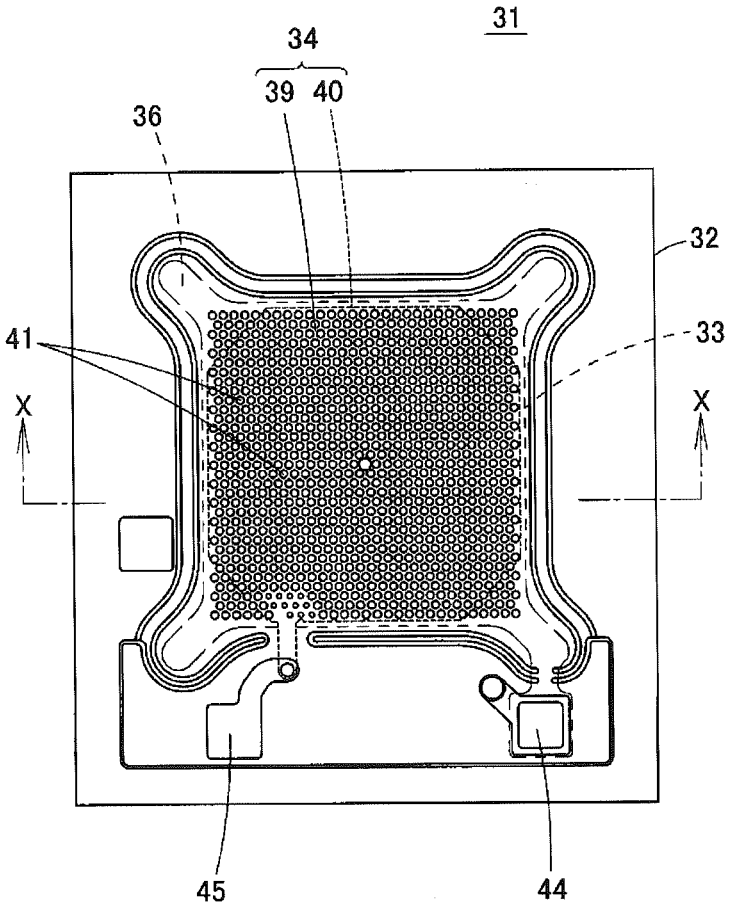
FIG. 6 is a plan view of an acoustic sensor according to Embodiment 1 of the present invention.
Figure 7:
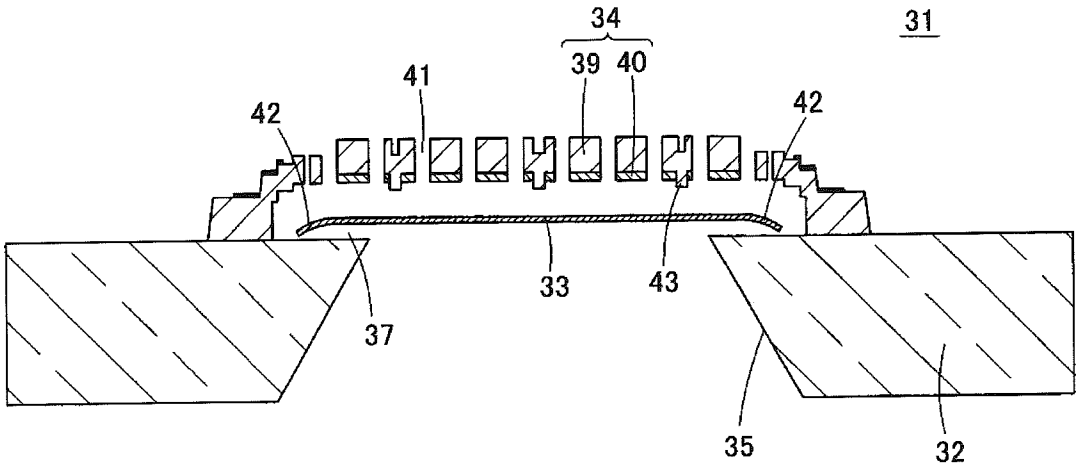
FIG. 7 is a cross-sectional view along line X-X in FIG. 6.
Figure 8:
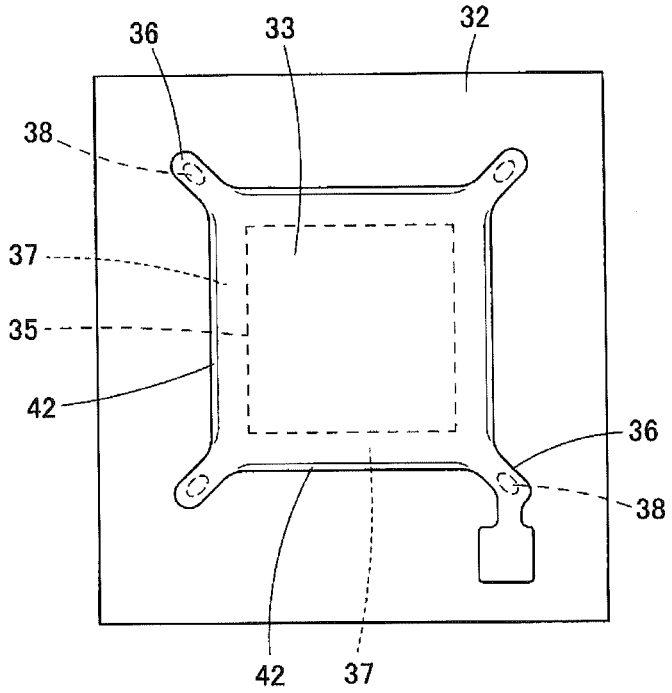
FIG. 8 is a plan view showing a diaphragm formed above an upper surface of a silicon substrate.
Figure 9:
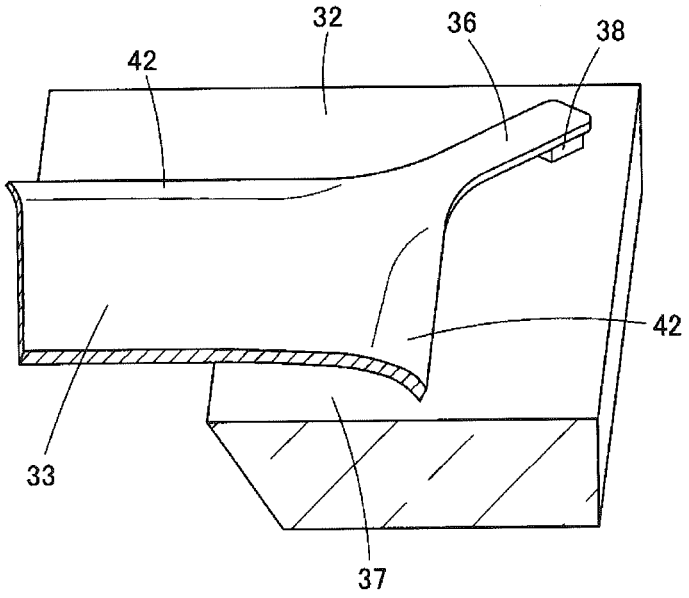
FIG. 9 is a partially cross-sectional perspective view showing a beam portion of the diaphragm formed above the upper surface of the silicon substrate and nearby portions.

With reference to FIGS. 6 and 7, the configuration of an acoustic sensor 31 according to Embodiment 1 of the present invention will be described. FIG. 6 is a plan view showing the acoustic sensor 31 in Embodiment 1 of the present invention. FIG. 7 is a cross-sectional view along line X-X in FIG. 6. FIG. 8 is a plan view showing the shape of a diaphragm 33 formed above an upper surface of a silicon substrate 32. FIG. 9 is a perspective view showing a portion of the diaphragm 33 formed above the upper surface of the silicon substrate 32.

The acoustic sensor 31 is a capacitance type sensor fabricated using MEMS technology. As shown in FIG. 7, in the acoustic sensor 31, the diaphragm 33 (vibration electrode film) is formed above an upper surface of the silicon substrate 32 (substrate), and a back plate 34 is provided above the diaphragm 33 via a minute air gap (gap).

A chamber 35 (cavity) is formed in the silicon substrate 32 made from single crystal silicon, penetrating therethrough from the front side to the back side. The chamber 35 constitutes a back chamber or a front chamber, depending on the usage pattern of the acoustic sensor 31. The wall surface of the chamber 35 may be a vertical plane, or may be inclined in a tapered shape.

The diaphragm 33 is formed by a polysilicon thin film having conductivity. As shown in FIG. 8, the diaphragm 33 is formed in a substantially rectangular shape with beam portions 36 extending horizontally from the corners in diagonal directions. The diaphragm 33 is disposed above the upper surface of the silicon substrate 32 so as to cover the top of the chamber 35. As shown in FIG. 9, lower surfaces of the beam portions 36 are supported by anchors 38. Thus, the diaphragm 33 is disposed above the upper surface of the silicon substrate 32, floated above the upper surface of the silicon substrate 32.

Gaps narrow in a height direction to allow acoustic vibrations or air to pass through them, that is, vent holes 37 are formed between the lower surface of the diaphragm 33 and the upper surface of the silicon substrate 32 around the chamber 35. The vent holes 37 are formed along portions where the diaphragm 33 faces the upper surface of the silicon substrate 32 (around the chamber 35) (hereinafter, these portions are each referred to as an edge portion of the diaphragm 33) between the beam portions 36. The vent hole 37 below each edge portion of the diaphragm 33 is short in a width direction (direction orthogonal to an edge of the top opening of the chamber 35) and long in a length direction (direction parallel to an edge of the top opening of the chamber 35).

As shown in FIGS. 7 and 9, the edge portions of the diaphragm 33, that is, the edge portions located between the beam portions 36 each have an edge (hereinafter, the outermost end of each edge portion of the diaphragm 33 is referred to as an end edge of the diaphragm 33.) curved in an arc shape so as to come closer to the upper surface of the silicon substrate 32. The curved portion constitutes a deformed portion 42. Thus, the deformed portion 42 is formed along almost the entire length of the vent hole 37 at each side.

Figure 10:
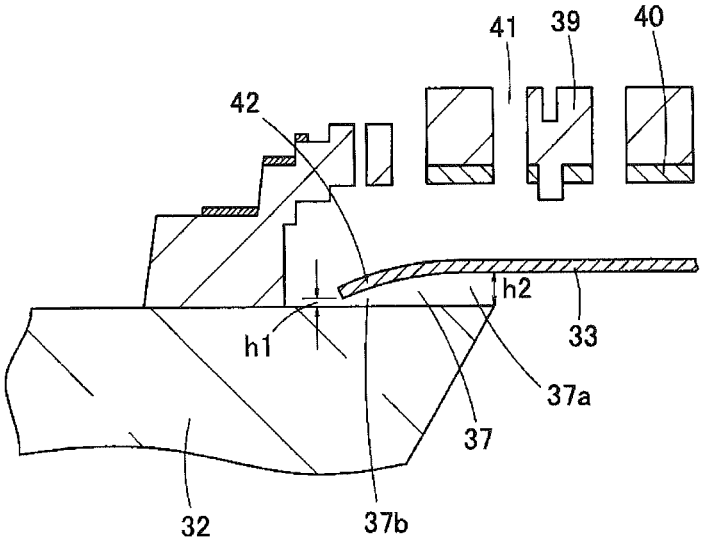
FIG. 10 is an enlarged cross-sectional view showing a vent hole in FIG. 7 and nearby portions.

FIG. 10 is an enlarged view of a portion in which the vent hole 37 is formed in FIG. 7. Since the deformed portion 42 of the diaphragm 33 is curved to bulge on the upper surface side, the height of a portion of the gap between the silicon substrate 32 and the diaphragm 33 narrower than the other portion and extending linearly, that is, a gap 37*b* at an outer peripheral portion of the vent hole 37 located below the deformed portion 42 is smaller than the height of the other portion of the vent hole 37, that is, a gap 37*a* at an inner peripheral portion of the vent hole 37 located below a flat portion of the diaphragm 33 other than the deformed portion 42. In particular, as for the height of the vent hole 37, that is, the gap between the lower surface of the diaphragm 33 and the upper surface of the silicon substrate 32, a height h1 of the vent hole 37 at the end edge of the diaphragm 33 is smaller than a height h2 of the vent hole 37 at the edge of the top opening of the chamber 35. A region of the vent hole 37 with a large height like the gap 37*a* at the inner peripheral portion located below the substantially flat region of the diaphragm 33 desirably has an area sufficiently greater than a region of the vent hole 37 with a small height like the gap 37*b* at the curved outer peripheral portion.

In order to curve the edge portion of the diaphragm 33 as described above, it is only required to control the stress gradient of the diaphragm 33 in a thickness direction. Specifically, in a conventional manufacturing process of acoustic sensors, a sacrificial layer (not shown) is formed on top of the silicon substrate 32, the diaphragm 33 is formed thereon with polysilicon, and then ions such as phosphorous (P) or boron (B) are injected into the entire surface of the diaphragm 33, followed by annealing. When the acoustic sensor 31 is fabricated by this manufacturing process, an inner stress gradient can be produced in the thickness direction of the diaphragm 33 by an ion implantation and annealing step, for example. At this time, when a stronger tension stress is generated on the lower surface side than on the upper surface side of the diaphragm 33, the edge portions of the diaphragm 33 are curved to bulge on the upper surface side, forming the deformed portions 42. Although an inner stress is generated also in a region other than the deformed portions 42 so as to curve the diaphragm 33, the four corners of the diaphragm 33 are fixed to the anchors 38, and thus the region other than the deformed portions 42 of the diaphragm 33 is strained and kept generally flat.

Inside the diaphragm 33, it is desirable to produce a stress gradient of 10 MPa/μm or more in the thickness direction of the diaphragm 33 so that the diaphragm 33 has a stronger tension stress in the lower surface than in the upper surface. This is because a stress gradient smaller than this cannot cause the edge portions of the diaphragm 33 to be curved sufficiently.

The edge portions of the diaphragm 33 do not need to extend smoothly along the length of the vent holes 37 as shown in FIGS. 8 and 9. The edge portions of the diaphragm 33 may wave or warp regularly or irregularly along the length of the vent holes 37.

The back plate 34 has a fixed electrode film 40 made from polysilicon provided on a lower surface of a protective film 39 made from SiN. As shown in FIGS. 6 and 7, the protective film 39 is formed in a substantially rectangular dome shape. It has a hollow portion below the protective film 39, and covers the diaphragm 33 with the hollow portion. The fixed electrode film 40 is provided opposite to the diaphragm 33.

A minute air gap (gap) is formed between the lower surface of the back plate 34 (that is, the lower surface of the fixed electrode film 40) and the upper surface of the diaphragm 33. The fixed electrode film 40 and the diaphragm 33 face each other, constituting a capacitor to detect acoustic vibrations and convert them into electrical signals.

The back plate 34 is almost entirely perforated with multiple acoustic holes 41 penetrating therethrough from the upper surface to the lower surface, for allowing acoustic vibrations to pass through them. As shown in FIG. 6, the acoustic holes 41 are arranged with regularity. In the illustrated example, the acoustic holes 41 are arranged in a triangular shape along three directions forming an angle of 120° with each other. Alternatively, they may be arranged in a rectangular shape or concentrically.

As shown in FIG. 7, minute cylindrical stoppers 43 are projected from the lower surface of the back plate 34. The stoppers 43 are provided to prevent the diaphragm 33 from sticking to the back plate 34. They project integrally from the lower surface of the protective film 39, pass through the fixed electrode film 40, and project from the lower surface of the back plate 34. The stoppers 43 are made from SiN like the protective film 39, and thus have insulation.

As shown in FIG. 6, an electrode pad 44 electrically connected to the diaphragm 33 and an electrode pad 45 electrically connected to the fixed electrode film 40 are provided on the top of the acoustic sensor 31.

In the acoustic sensor 31 configured as described above, when acoustic vibrations pass through the acoustic holes 41 and enter the air gap between the back plate 34 and the diaphragm 33, the thin-film diaphragm 33 is vibrated by the acoustic vibrations. When the vibrations of the diaphragm 33 change the gap distance between the diaphragm 33 and the fixed electrode film 40, the capacitance between the diaphragm 33 and the fixed electrode film 40 is changed. As a result, in the acoustic sensor 31, the acoustic vibrations (change in sound pressure) sensed by the diaphragm 33 constitute a change in the capacitance between the diaphragm 33 and the fixed electrode film 40, and are output as an electrical signal.

In the acoustic sensor 31, as shown in FIG. 10, the height of the vent hole 37 is small at one portion of the vent hole 37, specifically, at a portion on the outer peripheral side of the vent hole 37 in one or more embodiments of the present invention (hereinafter sometimes referred to as the gap 37*b* at the outer peripheral portion), and large at the other portion located on the inner peripheral side with respect to the gap 37*b* at the outer peripheral portion of the vent hole 37 (hereinafter sometimes referred to as the gap 37*a* at the inner peripheral portion). Therefore, the acoustic resistance is large in one region of the vent hole 37, and the acoustic resistance is small in the other region of the vent hole 37. The total acoustic resistance of the vent hole 37 equals to the acoustic resistance with a large resistance value in the one region connected in series to the acoustic resistance with a small resistance value in the other region. Thus, the total acoustic resistance of the vent hole 37 is determined by the acoustic resistance with the large resistance value. As a result, in the acoustic sensor 31, by reducing the height of the vent hole 37 at the gap 37*b* of the outer peripheral portion, the total acoustic resistance can be increased, achieving flatter frequency characteristics in the bass range of the acoustic sensor 31.

Figure 1:
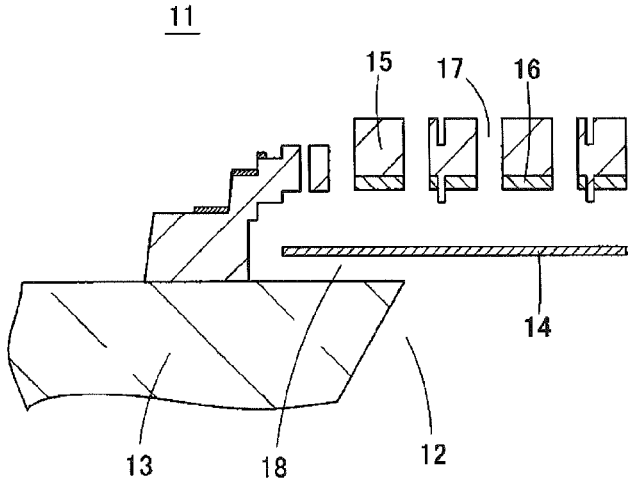
Fig. 1 PRIOR ART
FIG. 1 is a cross-sectional view showing a portion of a conventional acoustic sensor.
Figure 2:
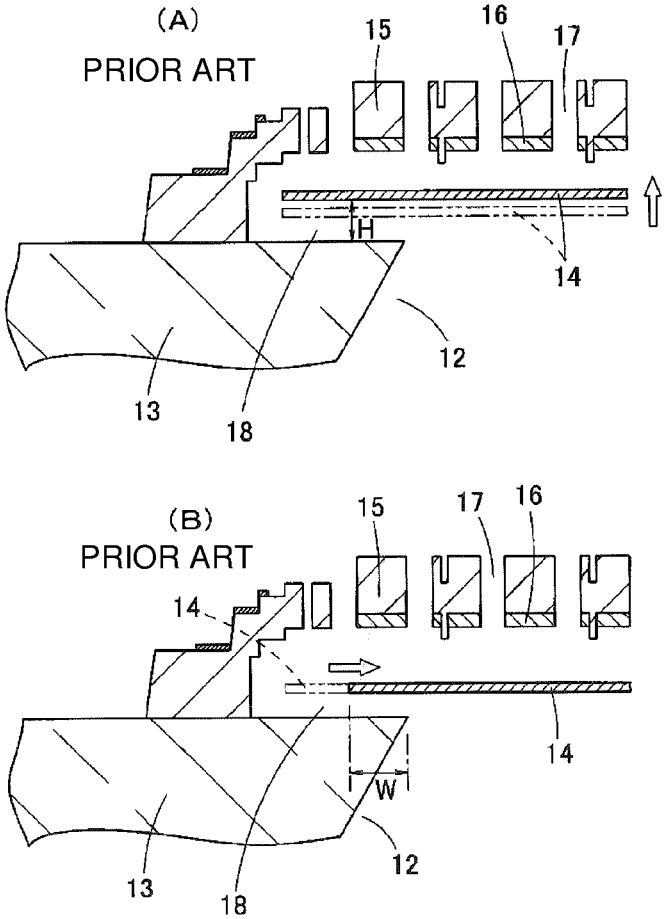
FIG. 2A is a cross-sectional view showing a state where the position of a diaphragm is moved upward in the acoustic sensor shown in FIG. 1.
FIG. 2B is a cross-sectional view showing a state where an end edge of the diaphragm is retracted toward the center in the acoustic sensor shown in FIG. 1.
Figure 3:
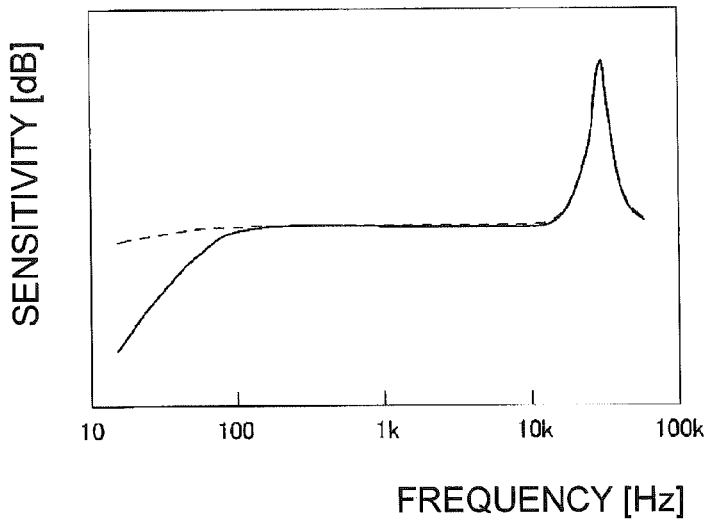
Fig. 3 PRIOR ART
FIG. 3 is a graph showing a relationship between the sensitivity of the acoustic sensor and frequencies (frequency characteristics).
Figure 11:
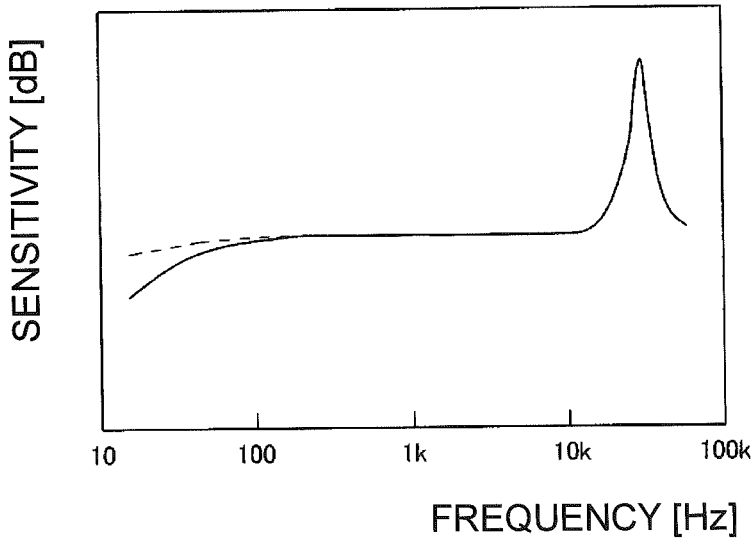
FIG. 11 is a graph showing the frequency characteristics of the acoustic sensor.

When the position of a diaphragm is moved upward to increase the height of a vent hole, with a flat diaphragm, while noise in the vent hole can be reduced to increase the S/N ratio, the sensitivity in the bass range decreases like the frequency characteristics shown in a solid line in FIG. 11, narrowing the flat range of the frequency characteristics in the bass range (see the above description of FIG. 3).

By contrast, in the acoustic sensor 31 in Embodiment 1, when the position of the entire diaphragm 33 is moved upward, the height of the vent hole 37 becomes higher at the gap 37*a* of the inner peripheral portion. Thus, by reducing a film dumping effect and reducing noise of the acoustic sensor 31, the S/N ratio can be increased. Furthermore, as a result of increasing the acoustic resistance at the gap 37*b* of the outer peripheral portion, the total acoustic resistance of the vent hole 37 is also increased, allowing for production of a sufficient sound pressure difference between the front and back of the diaphragm 33. Therefore, the sensitivity in the bass range is improved as shown in a dashed line in FIG. 11, and the frequency characteristics can be flattened also in the bass range. Thus, according to Embodiment 1, the acoustic sensor 31 with low noise and excellent frequency characteristics can be fabricated.

Figure 4:
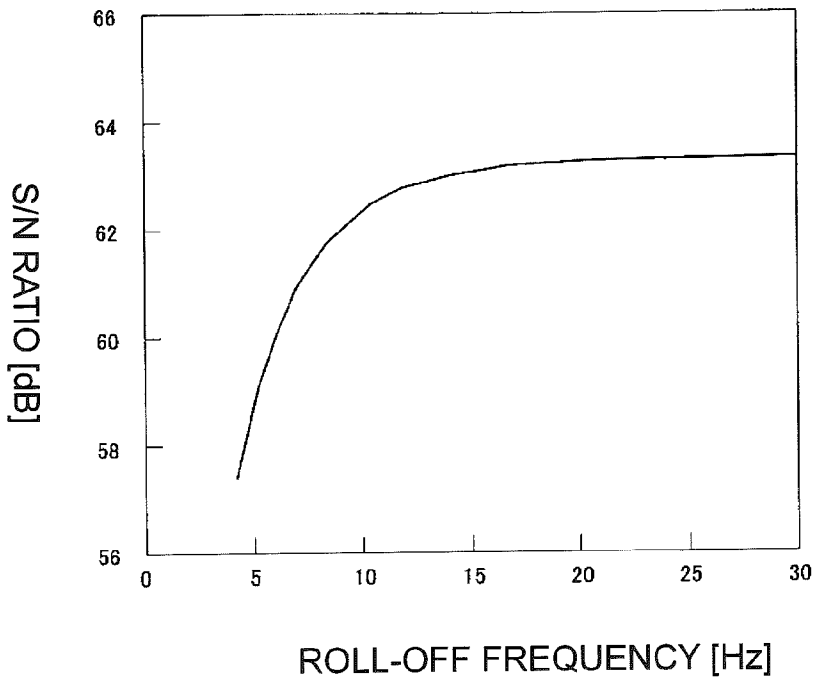
Fig. 4 PRIOR ART
FIG. 4 is a graph showing a relationship between the S/N ratio and the roll-off frequency in an acoustic sensor as in FIG. 1.
Figure 5:
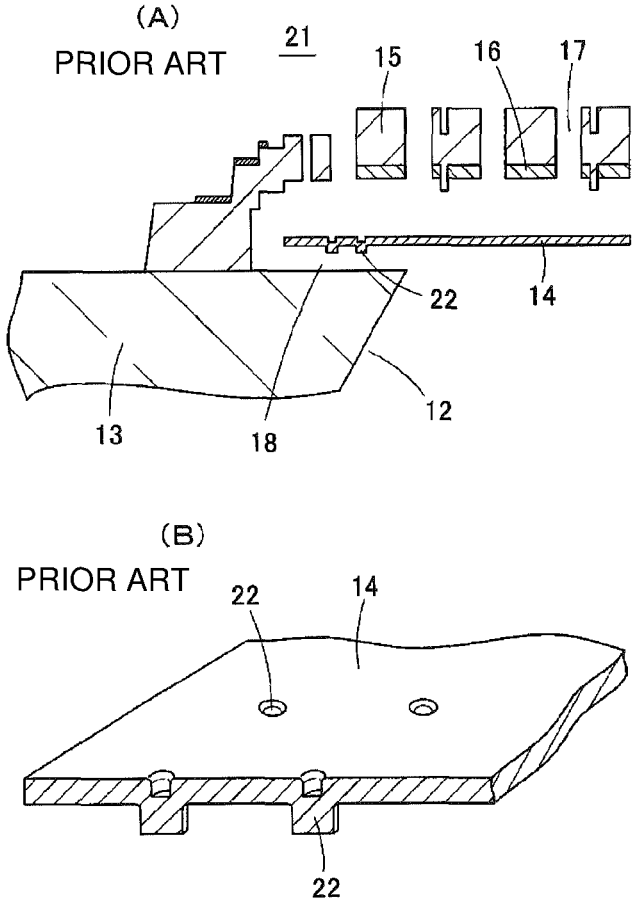
FIG. 5A is a cross-sectional view showing a portion of another conventional acoustic sensor.
FIG. 5B is a partially cross-sectional perspective view of a diaphragm used in the acoustic sensor in FIG. 5A.
Figure 12:
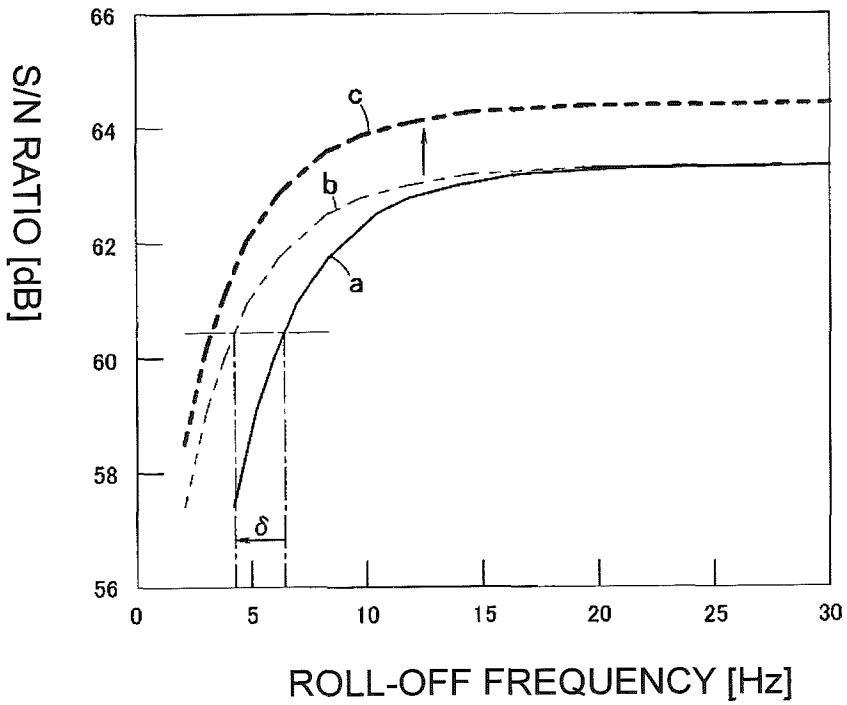
FIG. 12 is a graph showing a relationship between the S/N ratio and the roll-off frequency in the acoustic sensor.

This can also be explained using a graph of relationship between the S/N ratio and the roll-off frequency shown in FIG. 12. A curve a in a solid line shown in FIG. 12 is a relationship between the S/N ratio and the roll-off frequency in a typical acoustic sensor having a flat diaphragm, which is the same as the curve shown in FIG. 4. When only an end edge of the diaphragm is curved downward without changing the vertical position thereof, the distance between the end edge of the diaphragm and the upper surface of a silicon substrate is reduced, thus increasing acoustic resistance in a vent hole. As a result, the relationship between the S/N ratio and the roll-off frequency becomes a curve b in a thin dashed line shown in FIG. 12. That is, the curve b at this time becomes close to a bass-range portion of the curve a in the solid line horizontally translated to the low frequency side, and the roll-off frequency decreases by 6. Further, when the diaphragm with the end edge curved downward is moved upward, noise is reduced and the S/N ratio is increased. That is, as for the relationship between the S/N ratio and the roll-off frequency, the curve b is translated upward to be a curve c in a thick dashed line shown in FIG. 12. Even when the roll-off frequency is increased more or less by moving the diaphragm upward, a reduction in the roll-off frequency caused by curving the end edge of the diaphragm exceeds. Thus, by moving the diaphragm upward and curving the end edge of the diaphragm downward, it becomes possible to increase the S/N ratio and at the same time make the frequency characteristics in the bass range equal to the original frequency characteristics or closer to it to be flatter, compared with the case where the original flat diaphragm is used.

Figure 13:
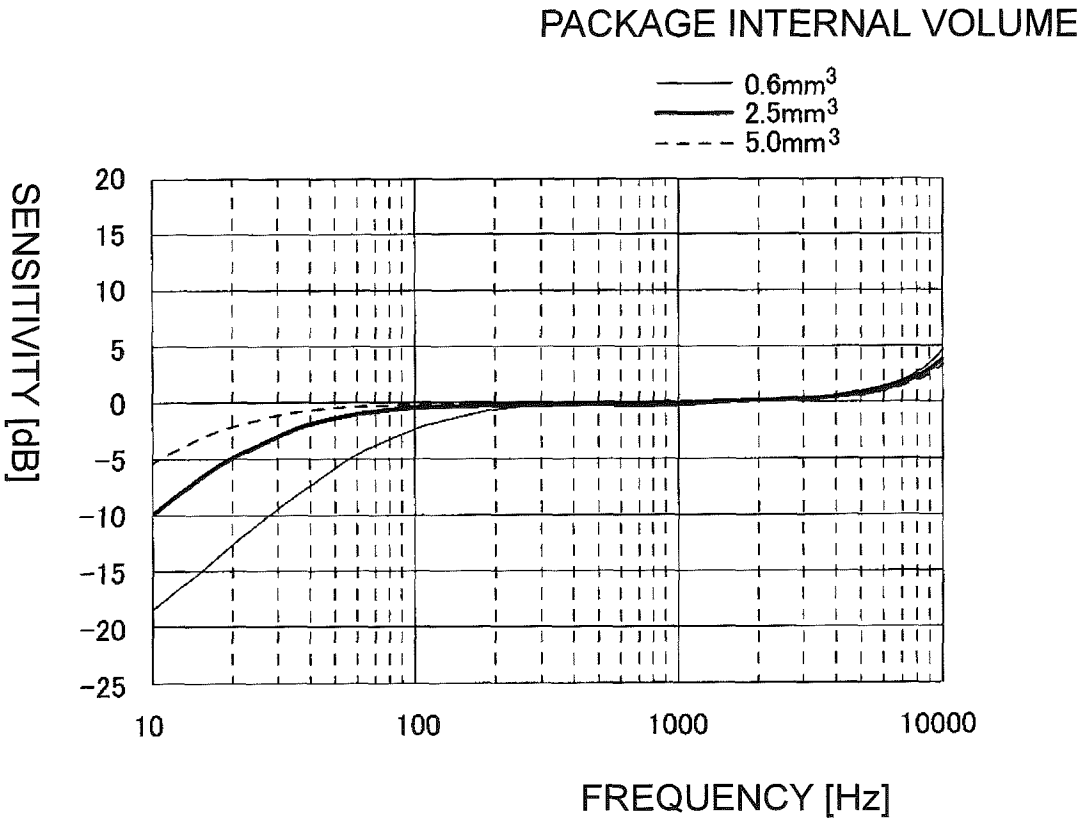
FIG. 13 is a graph showing a relationship between package internal volume and frequency characteristics.
Figure 14:
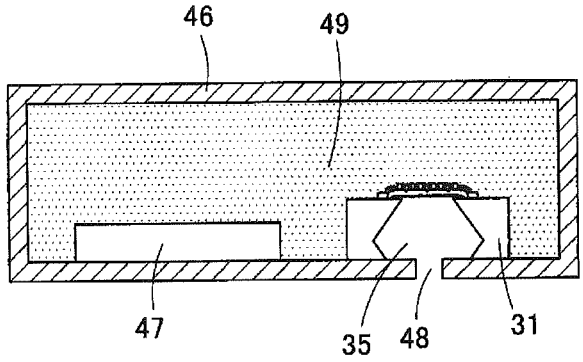
FIG. 14 is a diagram for illustrating the definition of the package internal volume.

FIG. 13 is a graph showing the relationship between package internal volume and frequency characteristics. Here, the package internal volume refers to the volume of a portion of space in a package not occupied by an acoustic sensor, a signal processing circuit, and others when the acoustic sensor is housed in the package together with the signal processing circuit and others. For example, in FIG. 14, the acoustic sensor 31 and a signal processing circuit 47 are housed in a package 46, mounted on the bottom surface in the package 46. The acoustic sensor 31 has the chamber 35 communicating with a sound introduction hole 48 in the package 46. The chamber 35 constitutes a front chamber. A region outside the acoustic sensor 31 and the signal processing circuit 47 of the space in the package 46 (region depicted by a dotted pattern in FIG. 14) constitutes a back chamber 49. The volume of the region depicted by the dotted pattern is the package internal volume. As the package becomes larger, the package internal volume becomes larger. Even with the same package size, as the acoustic sensor and the signal processing circuit become larger, the package internal volume becomes smaller.

FIG. 13 shows frequency characteristics with package internal volumes of 0.6 $mm^3$, 2.5 $mm^3$, and 5 $mm^3$. As can be seen from FIG. 13, when the acoustic sensor 31 is housed in the package, as the package internal volume becomes smaller, sensitivity reduction in the bass range becomes more marked. Therefore, as packages of acoustic sensors are becoming smaller, it becomes important to prevent degradation of frequency characteristics without increasing noise.

Figure 15:
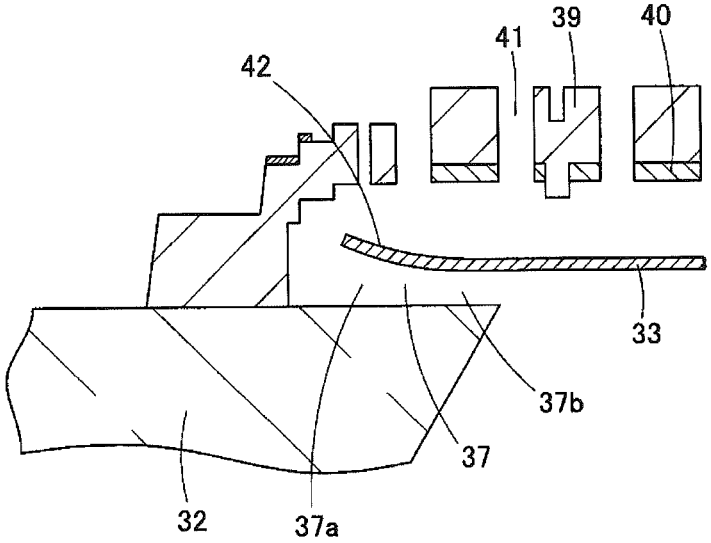
FIG. 15 is a cross-sectional view of a comparative example.

FIG. 15 shows a cross-sectional view of a comparative example. In this comparative example, an entire diaphragm 33 is made closer to an upper surface of a silicon substrate 32, an edge portion of the diaphragm 33 is curved to bulge to the lower surface side so that an end edge of the diaphragm 33 is away from the upper surface of the silicon substrate 32. In this comparative example, when the diaphragm 33 is moved closer to the upper surface of the silicon substrate 32 to increase acoustic resistance, the height of the vent hole 37 is reduced in most regions of the vent hole 37, increasing noise. Thus, in the comparative example, it is difficult to achieve both noise reduction and excellent frequency characteristics. Thus, when a deformed portion 42 is formed by curving, it is important to curve the end edge of the diaphragm 33 toward the upper surface of the silicon substrate 32.

Next, a configuration to partly narrow the distance between the edge portion of the diaphragm and the substrate upper surface in Embodiment 1 can be achieved in various forms other than curving the edge portion of the diaphragm in an arc shape as described above.

Figure 16:
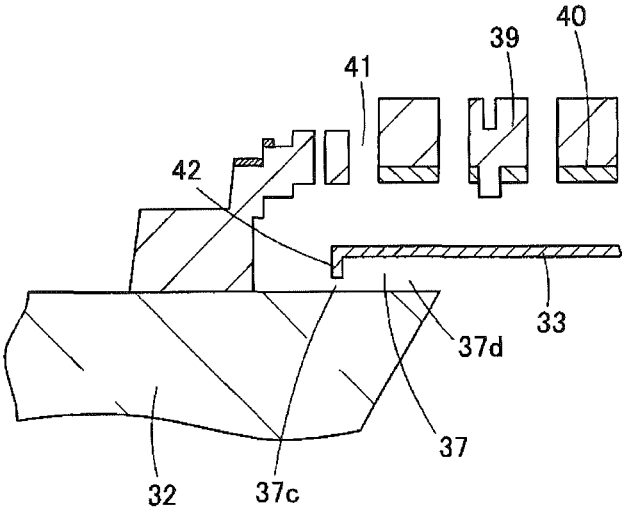
FIG. 16 is a cross-sectional view showing a portion of an acoustic sensor according to a modification of Embodiment 1 of the present invention.
Figure 17:
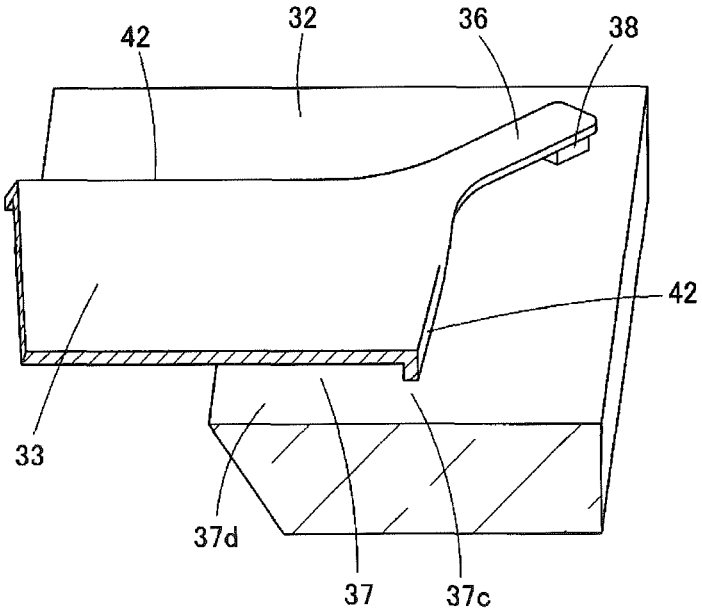
FIG. 17 is a perspective view showing a portion of a diaphragm used in the modification shown in FIG. 16.

In a modification shown in FIGS. 16 and 17, a distal end portion of the edge portion of the diaphragm 33 is bent along the edge portion substantially at a right angle toward the substrate upper surface. In this modification, the distance between the distal end of a deformed portion 42 and the substrate upper surface is shortened at the deformed portion 42 bent substantially at a right angle. Specifically, a gap 37*c* between a lower surface of the deformed portion 42 and an upper surface of the silicon substrate 32 constitutes one portion of the gap between the silicon substrate 32 and the diaphragm 33 narrower than the other portion and extending linearly. A gap 37*d* below a flat region of the diaphragm 33 other than the deformed portion 42 constitutes the other portion with a relatively wide gap. This shape allows the height of the vent hole 37 to be increased in the most part of the vent hole 37 and to be decreased only in the narrow portion at the deformed portion 42, thus providing a noticeable effect of reducing noise while reducing degradation of sensitivity in the bass range.

Figure 18:
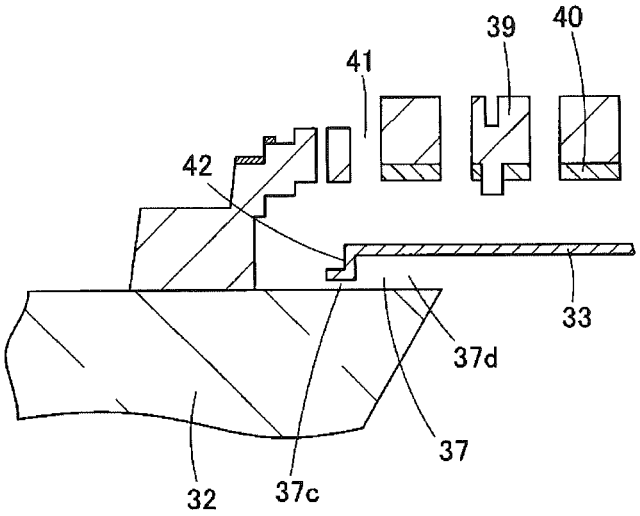
FIG. 18 is a cross-sectional view showing a portion of an acoustic sensor according to another modification of Embodiment 1 of the present invention.

In a modification shown in FIG. 18, the end edge of the diaphragm 33 is bent in a stepped shape to form a deformed portion 42. In this modification also, a gap 37*c* between a lower surface of the deformed portion 42 and an upper surface of the silicon substrate 32 constitutes one portion of the gap between the silicon substrate 32 and the diaphragm 33 narrower than the other portion and extending linearly. A gap 37*d* below a flat region of the diaphragm 33 other than the deformed portion 42 constitutes the other portion with a relatively wide gap. In this modification, acoustic resistance can be increased compared to the modification in FIGS. 16 and 17.

Figure 19:
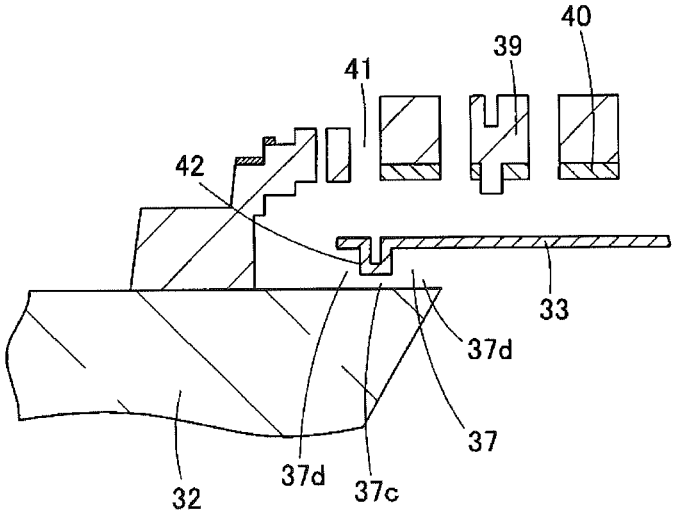
FIG. 19 is a cross-sectional view showing a portion of an acoustic sensor according to still another modification of Embodiment 1 of the present invention.

In FIG. 19, a portion near the end edge of the diaphragm 33 is bent in a bag shape to form a deformed portion 42. In this modification also, a gap 37*c* between a lower surface of the deformed portion 42 and an upper surface of the silicon substrate 32 constitutes one portion of the gap between the silicon substrate 32 and the diaphragm 33 narrower than the other portion and extending linearly. A gap 37*d* below a flat region of the diaphragm 33 other than the deformed portion 42 constitutes the other portion with a relatively wide gap. In this modification, the height of the vent hole 37 at the edge of the top opening of the chamber 35 and the height of the vent hole 37 at the end edge of the diaphragm 33 are large, and the height of the vent hole 37 at an intermediate portion between the edge of the top opening of the chamber 35 and the end edge of the diaphragm 33 is small.

The above-described modifications can also provide functions and effects similar to those of the acoustic sensor 31 in Embodiment 1.

The above-described deformed portions 42 do not necessarily need to extend in parallel with the end edge of the diaphragm 33, and may extend in an inclined direction with respect to the end edge of the diaphragm 33. However, when the deformed portions 42 extend in a direction orthogonal to the end edge of the diaphragm 33, acoustic resistance cannot be increased. Thus, the deformed portions 42 desirably extend in a direction not orthogonal to the end edge of the diaphragm 33.

Further, the deformed portions 42 do not need to extend linearly, and may extend in a curve or extend while bending. The extending direction may be branched.

Embodiment 2

Figure 20:
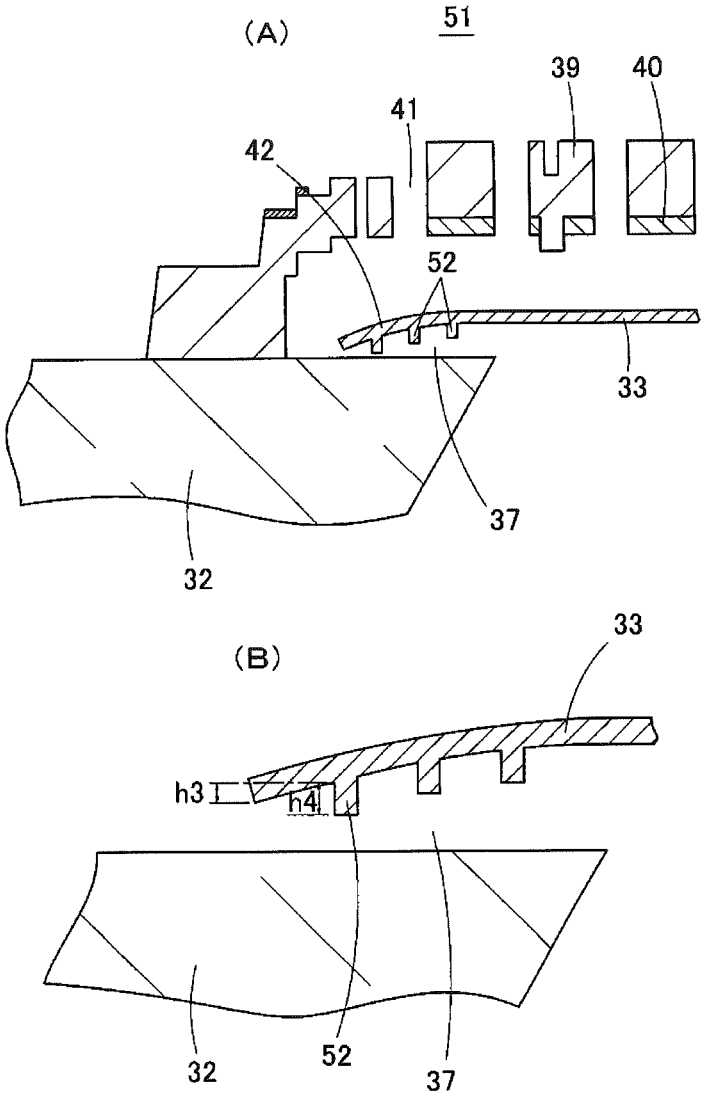
FIG. 20A is a cross-sectional view showing a portion of an acoustic sensor according to Embodiment 2 of the present invention.
FIG. 20B is an enlarged cross-sectional view of an edge portion of a diaphragm of the acoustic sensor shown in FIG. 20A.
Figure 21:
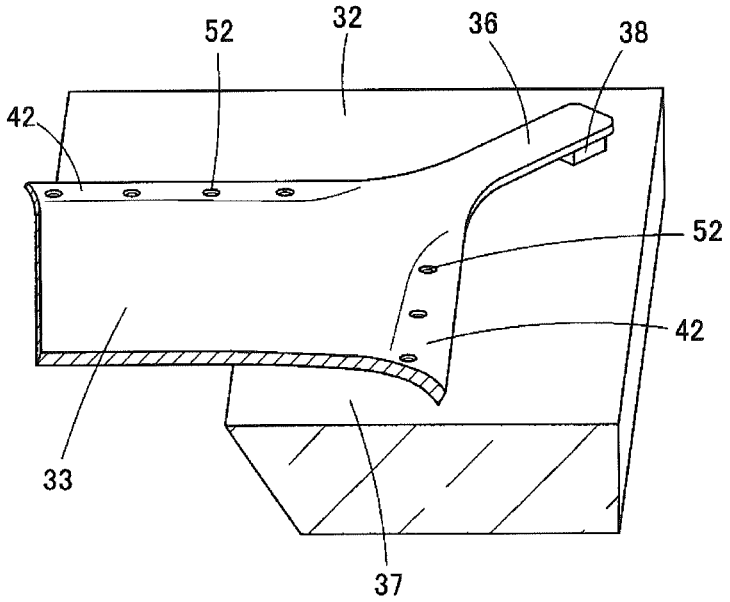
FIG. 21 is a perspective view showing a portion of the diaphragm used in the acoustic sensor shown in FIG. 20A.

FIG. 20A is a cross-sectional view showing a portion of an acoustic sensor 51 according to Embodiment 2 of the present invention. FIG. 20B is an enlarged cross-sectional view of a portion of a vent hole 37. FIG. 21 is an enlarged perspective view showing a corner portion of a diaphragm 33 formed above an upper surface of a silicon substrate 32. In this acoustic sensor 51, from a lower surface of an edge portion of the diaphragm 33, stoppers 52 in a pillar shape for preventing the diaphragm 33 from sticking to and being fixed to an upper surface of the silicon substrate 32 are projected at appropriate intervals. The other components of the acoustic sensor 51 are almost identical to those of the acoustic sensor 31 in Embodiment 1, and thus identical components are denoted by the same reference numerals in Embodiment 1 and will not be described.

Among the stoppers 52 projected from the lower surface of the edge portion of the diaphragm 33, the stopper 52 closest to an end edge of the diaphragm 33 has a projection length h4 greater than a height difference h3 between a proximal end of the stopper 52 and a lowermost end (end edge) of the diaphragm 33. By forming the stopper 52 satisfying this condition, the lowermost end of the diaphragm 33 can be prevented from sticking to and being fixed to the upper surface of the silicon substrate 32.

Embodiment 3

Figure 22:
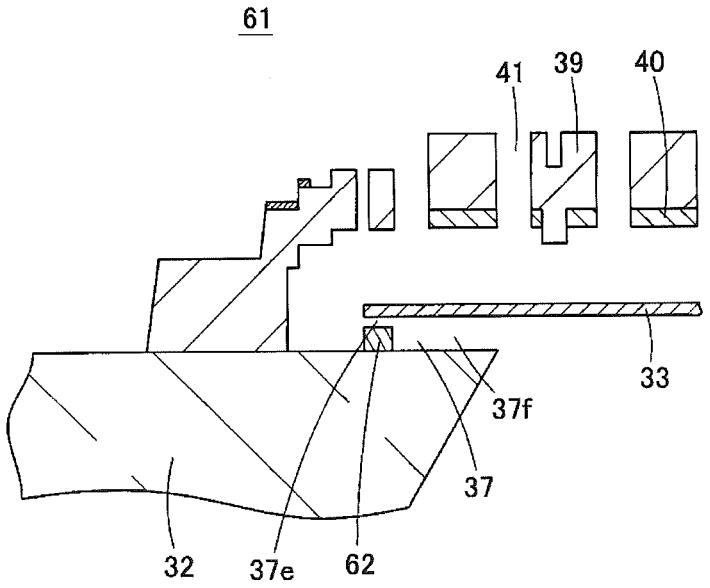
FIG. 22 is a cross-sectional view showing a portion of an acoustic sensor according to Embodiment 3 of the present invention.

FIG. 22 is a cross-sectional view showing a portion of an acoustic sensor 61 according to Embodiment 3 of the present invention. The acoustic sensor 61 uses a diaphragm 33 having an entirely flat edge portion. On the other hand, a projecting portion 62 is formed on an upper surface of a silicon substrate 32 at a position facing an end edge of the diaphragm 33. The projecting portion 62 extends along the length of a vent hole 37 or along a direction parallel to the end edge of the diaphragm 33. In one or more embodiments of the present invention, the height of the vent hole 37 at the position where the projecting portion 62 is provided is smaller than the other. Specifically, a gap 37*e* between an upper surface of the projecting portion 62 and a lower surface of the diaphragm 33 constitutes one portion of the gap between the silicon substrate 32 and the diaphragm 33 narrower than the other portion and extending linearly. A gap 37*f* between a region of the upper surface of the silicon substrate 32 other than a region where the projecting portion 62 is formed and the diaphragm 33 constitutes the other portion with a relatively wide gap. Therefore, sensitivity degradation in the bass range is prevented by increasing acoustic resistance at the projecting portion 62, and at the same time noise is reduced by increasing the height of the vent hole 37 at a portion where the projecting portion 62 is not provided.

Figure 23:
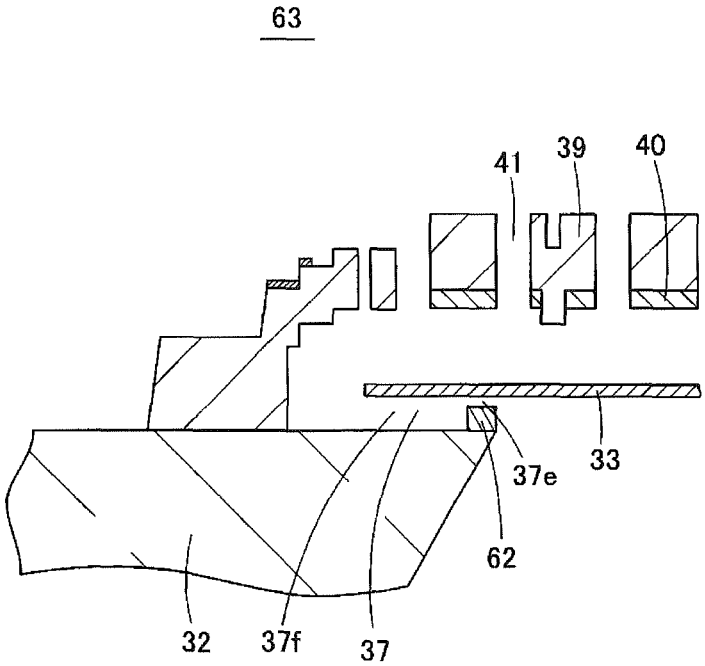
FIG. 23 is a cross-sectional view showing another form of Embodiment 3 of the present invention.

The projecting portion 62 may be provided at an edge abutting a top opening of a chamber 35 as in an acoustic sensor 63 shown in FIG. 23. Alternatively, the projecting portion 62 may be provided midway between the edge at the end edge of the diaphragm 33 and the edge abutting the top opening of the chamber 35.

Embodiment 4

Figure 24:
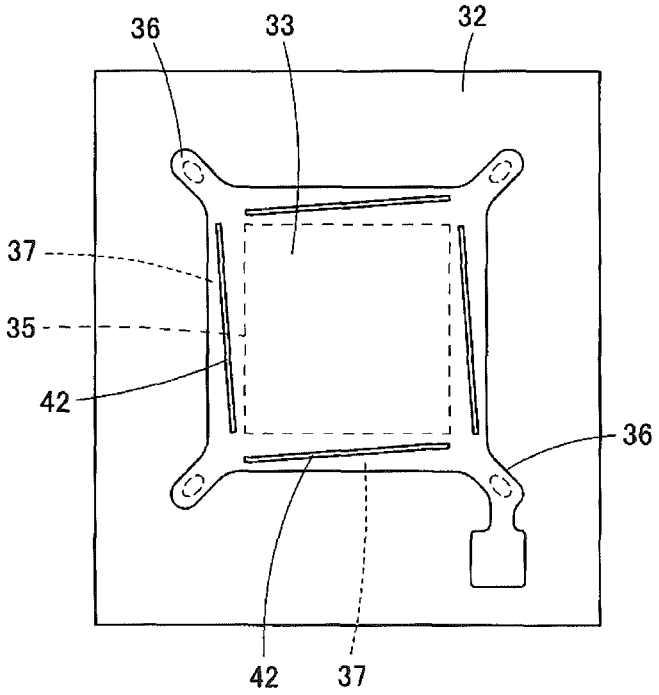
FIG. 24 is a plan view showing a diaphragm provided above an upper surface of a silicon substrate according to Embodiment 4 of the present invention.

FIG. 24 shows a diaphragm 33 provided above an upper surface of a silicon substrate 32 in Embodiment 4 of the present invention. In one or more embodiments of the present invention, deformed portions 42 with a cross-sectional shape as shown in FIG. 19, for example, extend in inclined directions with respect to end edges of the diaphragm 33.

One or more embodiments of the present invention can also be applied to MEMS speakers. Speakers and acoustic sensors (microphones) are opposite in signal conversion direction. However, the basic configurations of speakers and acoustic sensors are substantially the same, and thus descriptions of speakers will not be provided.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

REFERENCE KEY

31, 51, 61, 63 acoustic sensor
32 silicon substrate
33 diaphragm
35 chamber
37 vent hole
37*a* gap at an inner peripheral portion (the other portion of a gap)
37*b* gap at an outer peripheral portion (one portion of the gap)
37*c*, 37*e* gap (one portion of a gap)
37*d*, 37*f* gap (the other portion of the gap)
40 fixed electrode film
42 deformed portion
52 stopper

The invention claimed is:

1. An acoustic transducer comprising:

a substrate having a cavity that is open at a top of the substrate;

a vibration electrode film provided above the substrate so as to cover the cavity; and a fixed electrode film provided at a distance above the vibration electrode film, wherein a gap is formed between an upper surface of the substrate and a lower surface of the vibration electrode film around the cavity, wherein, in the gap across which the upper surface of the substrate and the lower surface of the vibration electrode film face each other, a narrow portion of the gap that is narrower than another portion of the gap is disposed, wherein the narrower portion of the gap extends linearly, and wherein the vibration electrode film comprises a linearly sloped portion that makes an acute angle with the upper surface of the substrate.

2. The acoustic transducer according to claim 1, wherein the narrow portion of the gap extends in a direction other than a direction orthogonal to an end edge of the vibration electrode film.

3. The acoustic transducer according to claim 2, wherein the narrow portion of the gap extends in a direction parallel to the end edge of the vibration electrode film.

4. The acoustic transducer according to claim 1, wherein a size of the gap at an end edge of the vibration electrode film is smaller than a size of the gap at an edge of the top opening of the cavity.

5. The acoustic transducer according to claim 4, wherein a portion of the vibration electrode film facing the upper surface of the substrate is curved in cross section such that the end edge of the vibration electrode film comes closer to the upper surface of the substrate.

6. The acoustic transducer according to claim 4, wherein a portion of the vibration electrode film facing the upper surface of the substrate is bent in cross section such that the end edge of the vibration electrode film comes closer to the upper surface of the substrate.

7. The acoustic transducer according to claim 1, wherein a size of the gap at an intermediate position between an edge of the top opening of the cavity and an end edge of the vibration electrode film is smaller than a size of the gap at the edge of the top opening of the cavity and a size of the gap at the end edge of the vibration electrode film.

8. The acoustic transducer according to claim 1, further comprising:

a stopper projected from a lower surface of a portion of the vibration electrode film facing the upper surface of the substrate, wherein the projection length of the stopper is greater than a height difference between a proximal end of the stopper and a lowermost end of the vibration electrode film.

9. The acoustic transducer according to claim 1, further comprising:

a projecting portion provided on the upper surface of the substrate in a region of the upper surface of the substrate facing the vibration electrode film, wherein the projecting portion reduces a size of the gap formed between the upper surface of the substrate and the lower surface of the vibration electrode film.

* * * * *